US007967585B2

(12) United States Patent
Fujiki et al.

(10) Patent No.: US 7,967,585 B2
(45) Date of Patent: Jun. 28, 2011

(54) METHOD FOR MANUFACTURING TROCHOID PUMP AND TROCHOID PUMP OBTAINED

(75) Inventors: Kenichi Fujiki, Gunma-ken (JP); Masaru Amano, Gunma-ken (JP); Keiichi Kai, Gunma-ken (JP); Takatoshi Watanabe, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 414 days.

(21) Appl. No.: 12/216,954

(22) Filed: Jul. 14, 2008

(65) Prior Publication Data

US 2009/0185940 A1 Jul. 23, 2009

(30) Foreign Application Priority Data

Oct. 21, 2007 (JP) ..... 2007-273259

(51) Int. Cl.
*F01C 1/10* (2006.01)
*F04C 2/10* (2006.01)
*F04C 18/10* (2006.01)

(52) U.S. Cl. ..... 418/170; 418/150; 418/169; 418/171

(58) Field of Classification Search ..... 418/169, 418/170, 171, 150, 1
See application file for complete search history.

(56) References Cited

U.S. PATENT DOCUMENTS 2,336,479 A * 12/1943 Graef ..... 418/169
(Continued)

FOREIGN PATENT DOCUMENTS

DE 27 58 376 (A1) 7/1979
(Continued)

OTHER PUBLICATIONS

European Search Report dated Jun. 30, 2010.
(Continued)

*Primary Examiner* — Thomas E Denion
*Assistant Examiner* — Mary A Davis
(74) *Attorney, Agent, or Firm* — McGinn IP Law Group, PLLC

(57) ABSTRACT

The present invention enables the manufacture of a trochoid pump having a crescent which has been considered theoretically impossible by employing an inner rotor of a trochoid pump. An inner rotor having a predetermined number N of teeth that is equal to or larger than 4 is formed in advance. In order to manufacture an outer rotor with a predetermined number (N plus a natural number equal to or larger than 2) of teeth, row circles that are identical to a drawn circle are disposed so as to bring the row circles into contact with the tooth bottomland of the inner rotor tooth profile, the inner rotor tooth profile is rotated by half a tooth about the center of the inner rotor and the outer rotor tooth profile is also rotated by half a tooth of the predetermined number (N plus a natural number equal to or larger than 2) of teeth about a virtual center of the outer rotor including the row circles, an established center is determined from the virtual center or the like at the time at which the contact state is assumed, a reference circle is drawn that has a radius from the established center to the row circles and that has the total predetermined number (N plus a natural number equal to or larger than 2) of the equidistantly spaced row circles to form the row circles as outer rotor tooth tips, thereby manufacturing the outer rotor tooth profile.

8 Claims, 15 Drawing Sheets

U.S. PATENT DOCUMENTS

| | | | | | |
|---|---|---|---|---|---|
| 2,940,399 | A | * | 6/1960 | Zieg et al. | 418/169 |
| 3,887,310 | A | * | 6/1975 | Gerber | 418/169 |
| 3,907,470 | A | * | 9/1975 | Harle et al. | 418/170 |
| 4,155,686 | A | | 5/1979 | Eisenmann et al. | |
| 4,177,025 | A | | 12/1979 | Eisenmann et al. | |
| 5,163,826 | A | * | 11/1992 | Cozens | 418/170 |

FOREIGN PATENT DOCUMENTS

| | | | | |
|---|---|---|---|---|
| EP | 0 347 738 | A2 | | 12/1989 |
| GB | 1 438 917 | A | | 6/1976 |
| JP | 59-131787 | | | 7/1984 |
| JP | 61210283 | A | * | 9/1986 |
| JP | 2-62715 | | | 12/1990 |

OTHER PUBLICATIONS

An English Version of the summary pages of a Chinese Office Action dated Mar. 16, 2011.

* cited by examiner

METHOD FOR MANUFACTURING TROCHOID PUMP AND TROCHOID PUMP OBTAINED

BACKGROUND OF THE INVENTION

1. Field of the Invention

The present invention relates to a novel method for manufacturing a trochoid pump that enables the manufacture of a pump provided with a crescent which has been considered theoretically impossible by employing an inner rotor of a trochoid pump, and also relates to the trochoid pump obtained.

2. Description of the Related Art

The so-called trochoid pumps in which a trochoid shape is used for the rotor tooth profile or the so-called crescent pumps in which a crescent-shaped member called a crescent is disposed between an inner rotor and an outer rotor have been widely used as oil pumps for vehicles.

The trochoid pump is a pump in which the difference in the number of teeth between an outer rotor and an inner rotor having a trochoid curve is one and the oil is sucked in and discharged due to expansion and contraction of a space between the teeth (cell) caused by the rotation of the rotors. Such trochoid pumps feature a high discharge flow rate, a low noise level, and a high efficiency.

However, the following problem is associated with trochoid pumps. Thus, the zone partitioning the cells is represented by a single line where a tooth surface (convexity) and a tooth surface (convexity) of the inner rotor and outer rotor come into contact, i.e., by the so-called linear contact of two convexities, and therefore the pressure can be easily released to the adjacent cell. Yet another problem is that because the suction port and discharge port are separated by one tooth only, the pressure can be easily released, and the discharge pressure in the trochoid pump cannot be that high.

Specific features of a trochoid pump are listed below in a simple manner. (a) the tooth profile of the outer rotor maintains a state in which it rolls without slip with respect to the tooth profile of the inner rotor (trochoid curve) with a trochoid tooth profile, while the respective inner and outer teeth come into mutual contact by parts thereof; (b) the outer rotor is formed to have only one tooth more; (c) the discharge pressure cannot be that high. Summarizing, in a trochoid pump, the inner and outer tooth profiles roll with respect to each other, without slip or separation.

On the other hand, a crescent pump is an internal gear pump in which the crescent-shaped member called a crescent is disposed between the tooth tips of the inner rotor and tooth tips of the outer rotor. The difference in the number of teeth between the inner rotor and outer rotor is two or more, and an involute curve is most often used as a tooth profile shape. A high sealing ability of the teeth is a specific feature of such crescent pump. The trochoid pump features liner contact of a convexity (tooth surface) and a convexity (tooth surface), wherein in the crescent pump, the linear contact of a surface (crescent) and a convexity (tooth surface) is present continuously through the crescent length (several teeth). As a result, the discharge pressure can be increased over that of the trochoid pump.

The following problems are also associated with the crescent pump. Thus, because a non-trochoid curve such as an involute curve has to be used for the tooth profile, the discharge flow rate is low, the noise level is high, and the efficiency is low. Thus, specific features of a trochoid pump are listed below in a simple manner: (a) the number of teeth of the outer rotor is larger by two or more than that of the inner rotor; (b) the inner rotor and the crescent, and the crescent and the outer rotor are in sliding contact; and (c) the discharge pressure is high, the discharge flow rate is low, noise level is high, and efficiency is low.

The conventional trochoid pumps are based on the traditional concept according to which the difference in the number of teeth between the inner rotor and outer rotor is one and a space (cell) is formed between the teeth. Accordingly, a concept of a trochoid pump in which the difference in the number of teeth between the inner rotor and outer rotor is two or more has not yet been suggested.

This is because the outer rotor typically differs in the number of teeth by one from the inner rotor that has a trochoid tooth profile forming the trochoid pump, and a method for forming an outer rotor with such difference in the number of teeth has been established as shown in Japanese Examined Patent Publication No. 2-62715. Regarding trochoid pumps, there are no specific (publicly known) technical documents relating to an outer rotor that demonstrates smooth engagement and has the number of teeth by two or more larger than that of the inner rotor with a trochoid tooth profile, and such configuration is unknown. Moreover, forming such a configuration is by itself difficult. A patent document search relating to this issue has been conducted.

Japanese Patent Application Laid-open No. 59-131787 (from page 2, upper left row, second line from the bottom, to page 2, upper right row, first line) describes the following: "... using a similar crescent 5 is preferred because it enables a countermeasure to be devised, but with the rotor of the above-described conventional shape, this is impossible". In other words, this documents discloses that a crescent cannot be used in a trochoid pump. Further, although drawings of Japanese Patent Application Laid-open No. 59-131787 show a configuration in which a crescent is disposed between an inner rotor and an outer rotor, it is part of the tooth surface of the inner rotor that has a trochoid shape, and the larger portion of the remaining tooth surface is represented by a circular arc.

Let us consider a trochoid shape. A trochoid shape is a curve produced when two circles roll, without slip, while maintaining contact with each other. Therefore, the inner rotor and outer rotor also revolve without slip in a state in which all the teeth are in contact. By contrast, with an involute curve of a non-trochoid shape, the tooth surface and tooth surface revolve with a slip. Therefore, although the revolution seems to be the same, the operation of teeth is significantly different.

Further, when all the teeth of the outer rotor and inner rotor having a trochoid shape revolve without slip, while maintaining contact with each other, the difference in the number of teeth can be only one. The reason therefor will be explained below in greater details. First, the concave and convex tooth profile shapes of the inner rotor and outer rotor are substantially identical to ensure smooth rotation. If the tooth profile shape of the inner rotor and outer rotor are different, good engagement is impossible. In other words, to ensure revolution without slip when the tooth profile shape is substantially identical, the rolling distance of the tooth surface of one tooth of the inner rotor and the rolling distance of the tooth surface of one tooth of the outer rotor have to be identical.

Because the rolling distance of the tooth surface of one tooth is the same in the inner rotor and outer rotor and the outer rotor is located on the outside of the inner rotor, the number of teeth in the outer rotor is increased. Further, in order to ensure smooth revolution in a state in which the difference in the number of teeth is two or more, the outer rotor has to be increased in size so that a clearance is formed between the outer rotor and the inner rotor. Where the tooth profile is determined, the rolling distance of the tooth surface of one tooth is also determined, and because the number of teeth in the rotor is a natural number, the length of rotor tooth surface in the circumferential direction is also determined. Therefore, if the tooth profile and the number of teeth are given, there is practically no freedom in selecting the rotor diameter.

As described above, if the tooth profile and number of teeth are given, the adjustment of rotor diameter is practically impossible. Therefore, where the difference in the number of teeth is set to two, a large clearance always appears between the inner rotor and outer rotor. The larger is the difference in the number of teeth, the larger is the clearance between the outer rotor and inner rotor. However, when a clearance appears between the tooth surface of the inner rotor and the tooth surface of the outer rotor, smooth revolution inherent to the configuration with the outer rotor and inner rotor of a trochoid shape, in the above-described mathematical meaning thereof, becomes impossible. For this reason, the difference in the number of teeth between the outer rotor and inner rotor having a trochoid shape is one. This is the reason why within the framework of the conventional technology (patent documents and the like) there are only pumps in which the difference in the number of teeth between the inner rotor having a trochoid shape and the outer rotor that is smoothly meshed therewith is one and no clearance is present between the tooth surface of the inner rotor and the tooth surface of the outer rotor.

SUMMARY OF THE INVENTION

Japanese Examined Patent Application No. 2-62715 and Japanese Patent Application Laid-open No. 59-131787 describe trochoid pumps in which the difference in the teeth number is one and no clearance is present between the tooth surface of the inner rotor and the tooth surface of the outer rotor. Therefore, the idea of disposing a crescent (crescent-shaped member) between the tooth surface of the inner rotor and the tooth surface of the outer rotor was inconceivable.

The above-described background art suggests a technical task (object) of developing a perfect pump in which the advantages of trochoid pumps and crescent pumps are enhanced and shortcomings thereof are eliminated, that is, a pump in which smooth revolution inherent to trochoid pumps is maintained and, at the same time, a crescent structure that increases the discharge pressure can be obtained.

Thus, the object is to realize a trochoid oil pump that has an inner rotor of a trochoid shape, an outer rotor that revolves in smooth engagement therewith, and a crescent of an almost crescent-like shape that is disposed between the inner rotor of a trochoid shape and the outer rotor that revolves in smooth engagement therewith, wherein the difference in the number of teeth between the inner rotor of a trochoid shape and the outer rotor that revolves in smooth engagement therewith is at least two or more. In other words, the problem (technical task or object) to be resolved by the present invention is to provide a pump based on a new concept that cannot be manufactured by combining the inventions described in Japanese Examined Patent Application No. 2-62715 and Japanese Patent Application Laid-open No. 59-131787, this pump having a trochoid tooth profile with a crescent inserted therein. As a result, a pump will be provided that has a high discharge flow rate, a low noise level, a high efficiency, and a high discharge pressure, those being the merits inherent to a combination of a crescent and a trochoid.

The inventors have conducted a comprehensive research aimed at the resolution of the above-described problems. The results obtained demonstrated that the problems can be resolved by the invention set forth in claim 1 that provides a method for manufacturing a trochoid pump having a crescent, wherein an inner rotor, which has an inner rotor tooth profile as a trochoid tooth profile represented by a drawn circle of a predetermined radius, is formed in advance with the number of teeth of the inner rotor being set to a predetermined number N that is equal to or larger than 4, in order to manufacture an outer rotor with a predetermined number (N plus a natural number equal to or larger than 2) of teeth, row circles that are identical to the drawn circle are disposed so as to bring the row circles into contact with a tooth bottomland of the inner rotor tooth profile, the inner rotor tooth profile is rotated by half a tooth about the center of the inner rotor and the outer rotor tooth profile is also rotated by half a tooth of the predetermined number (N plus a natural number equal to or larger than 2) of teeth about an appropriate virtual center of the outer rotor including the row circles, an established center is determined by a mathematical expression from the virtual center at the time at which the row circles assume, in the course of the rotation, a state of being in contact, without penetration or separation, with the tooth bottomland or tooth tip zone of the inner rotor tooth profile, or from an interval between adjacent row circles at the time at which the contact state is assumed, a reference circle is drawn that has a radius from the established center to the row circles and that has the total predetermined number (N plus a natural number equal to or larger than 2) of the equidistantly spaced row circles to form the row circles as outer rotor tooth tips, and the outer rotor tooth profile is manufactured.

The invention set forth in claim 2 resolves the above-described problems by the above-described configuration, wherein the half-tooth rotation process is reversed such that the inner rotor tooth profile is rotated by half a tooth about the center of the inner rotor and the outer rotor tooth profile is also rotated by half a tooth of the predetermined number (N plus a natural number equal to or larger than 2) of teeth about the virtual center from the time at which a state is assumed in which the row circles come into contact with the tooth bottomland or tooth tip zone of the inner rotor tooth profile, while taking the appropriate virtual center of the outer rotor including the row circles as a center, the row circles are disposed so as to be in contact with the tooth bottomland of the inner rotor tooth profile, and the virtual center is determined as the established center. The invention set forth in claim 3 or 6 resolves the above-described problems by the above-described configuration, wherein a reference circle that has the total predetermined number (N plus a natural number equal to or larger than 2) of the equidistantly spaced row circles is drawn and then an appropriate circle is drawn that serves as an outer rotor tooth bottomland in a zone at the tooth tip end or closer to the tooth tip end of the inner rotor from the established center to form the outer rotor tooth bottomland, and the outer rotor tooth profile is manufactured.

The invention set forth in claim 4 or 7 resolve the above-described problems by the above-described configuration, wherein in order to manufacture (N+2) or (N+3) outer rotor teeth, the inner rotor tooth profile is rotated by half a tooth about the inner rotor center and the outer rotor tooth profile is also rotated by half a tooth of the (N+2) or (N+3) teeth about the appropriate virtual center of the outer rotor including the row circles, and the outer rotor tooth profile is manufactured. The inventions set forth in claim 5 or 8 resolves the above-described problems by the above-described configuration, wherein the inner rotor has an inner rotor tooth profile produced from a drawn circle of a predetermined radius based on a trochoid curve produced by a rolling circle having an appropriate eccentricity with respect to a base circle.

The invention resolves the above-described problems by providing a trochoid pump manufactured by the method for manufacturing a trochoid pump of the above-described configuration. The invention resolves the above-described problems by providing a trochoid pump, wherein the trochoid pump has an inner rotor tooth profile as a trochoid tooth profile represented by a drawn circle of a predetermined radius, the predetermined number (N plus a natural number equal to or larger than 2) of teeth of an outer rotor are formed with respect to an appropriate reference circle with a tooth profile that meshes with the inner rotor with a predetermined number N of teeth that is equal to or larger than 4, so as to be in contact with a tooth bottomland of the inner rotor tooth profile on row circles that are equal to the drawn circles, the row circles are formed as outer rotor tooth tips, and a crescent is provided in a clearance between a tooth surface of the inner rotor and a tooth surface of the outer rotor.

As for the invention set forth in claim 1, the design concepts of a trochoid pump and a pump having a crescent differ from each other, and linking the two concepts has been impossible. In other words, in the conventional method for designing a rotor having a trochoid shape, it is necessary that all the tooth tips of the inner rotor and all the tooth tips of the outer rotor roll theoretically without slip, while theoretically maintaining contact. Further, with the conventional design method, it is impossible to design a rotor having a trochoid shape with a large clearance between the inner rotor and outer rotor in which the difference in the number of teeth between the rotors is equal to or larger than 2. With the present invention, it is possible to produce a trochoid pump with a clearance between the inner rotor and outer rotor in which the difference in the number of teeth between the rotors is equal to or larger than 2, and it is possible to design and manufacture an outer rotor tooth profile of the outer rotor by applying the inner rotor having an almost perfect trochoid shape to a pump of a type having a crescent-shaped crescent. The present invention provides a pump with features of both the crescent and the trochoid, this pump having a high discharge flow rate, a low level of noise, a high efficiency, and a high discharge pressure. Further, because a trochoid tooth profile is used instead of using an involute tooth profile as in the usual crescent pump, a pump with high durability in which the tooth surface wear is inhibited can be provided.

Among the gears with crescent and involute tooth profiles, gears with a plurality of differences in the number of teeth are widely used. However, with the involute tooth profile, the slip between tooth surfaces is large, thereby enhancing the tooth surface wear and decreasing durability. With the present invention, because the slip between the tooth surfaces can be minimized by using a trochoid tooth profile, high durability is obtained. Further, because sealing ability of spaces between the teeth (cells) is increased, pump performance can be increased. The effect attained with the invention set forth in claim 2 is identical to that obtained with the invention set forth in claim 1. With the invention set forth in claim 3 or 6, the tooth bottomland diameter of the outer rotor can be determined by a desired clearance by using the tooth tip end of the inner rotor as a reference. The invention set forth in claim 4 or 7 makes it possible to perform the design in accordance with the present invention by the same method for any difference in the number of teeth, but is especially applicable to the pumps in which the difference in the number of teeth is 2 or 3, such a difference being frequently employed. With the invention set forth in claim 5 and 8, the inner rotor is produced with a tooth profile having a trochoid shape, which is a typical widely used configuration. Therefore, the design and manufacture are facilitated. With the invention, a trochoid pump is provided that is manufactured by excellent manufacturing method. Therefore, pump performance demonstrated with the crescent can be improved.

DESCRIPTION OF THE PREFERRED EMBODIMENTS

Embodiments of the method for manufacturing a trochoid pump using a crescent in accordance with the present invention will be described below with reference to the appended drawings. An inner rotor 1 itself has the usual trochoid tooth profile, and the design method thereof is identical to the usual method for finding a trochoid tooth profile. Although a method for manufacturing the inner rotor 1, that is, a method for finding the trochoid tooth profile of the inner rotor 1 represents the conventional technology, this method will still be explained below because an outer rotor 2 is manufactured with reference to the inner rotor 1.

Figure 14:
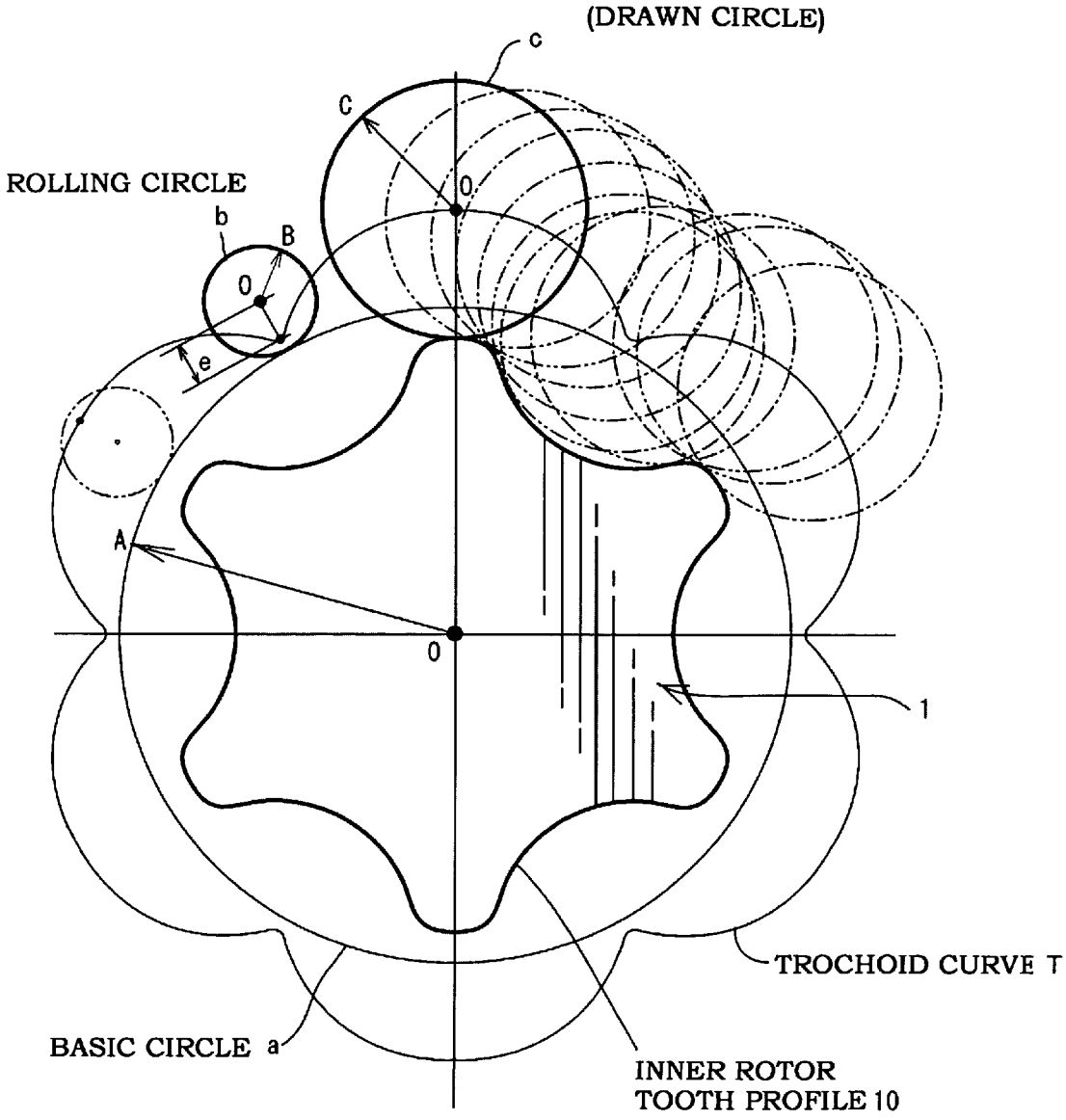
FIG. 14 illustrates a process of manufacturing a tooth profile of the inner rotor.

As shown in FIG. 14, the inner rotor 1 is formed with an inner rotor tooth profile 10 determined by a drawn circle c (radius OC) of a predetermined radius based on a trochoid curve T produced by a rolling circle b (radius OB) having an appropriate eccentricity e with respect to a basic circle a (radius OA). In other words, the inner rotor 1 has the inner rotor tooth profile 10 based on the trochoid curve T. A drawn circle c (bottomland shape of the inner rotor) of the inner rotor 1 is used as the tooth tip profile of the outer rotor 2. This is because tooth profile shapes will be different unless the identical drawn circles c are used for the inner rotor 1 and outer rotor 2 (the row circles 11 have the same tooth profile shape) and, therefore, using the drawn circle as the tooth tip profile of the outer rotor is necessary to rotate the two rotors smoothly. In other words, the row circles 11 employed for manufacturing the outer rotor 2 are identical to the drawn circles c employed for manufacturing the inner rotor 1. A method for designing the outer rotor 2 in accordance with the present invention that comprises the crescent 3, differs in the number of teeth by 2 or more from the inner rotor, and smoothly meshes therewith based on the inner rotor 1 of a trochoid tooth profile will be described below based on this assumption. Where the difference in the number of teeth is one, the usual trochoid pump is realized. In accordance with the present invention, this difference is 2 or more, and the configuration is such that a large gap S (clearance) is opened between the inner rotor tooth profile 10 of the inner rotor 1 and the outer tooth profile 20 of the outer rotor 2 and the crescent 3 can be fitted therein.

First Embodiment of the Present Invention

Manufacture (Design) Procedure in the Case of an Inner Rotor with 6 Teeth and an Outer Rotor with 8 Teeth In the first embodiment, the number of teeth of the inner rotor is taken as 6 (as described hereinabove) and a method for designing an outer rotor with 8 teeth, the difference in the number of teeth between the rotors being 2, that smoothly meshes with the inner rotor will be described with reference to FIG. 2 to FIG. 8.

Figure 3A:
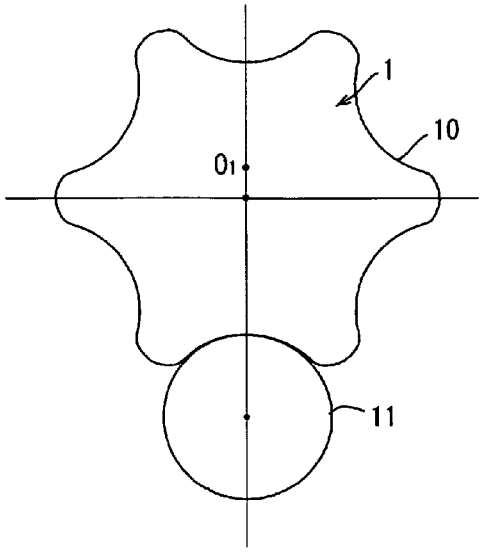
FIG. 3A illustrates a state in which a row circle comes into contact with the inner rotor, FIG. 3B being an enlarged view of the main portion of FIG. 3A, FIG. 3C illustrating a state in which the inner rotor is rotated by 30 degrees, and the outer rotor including the row circle is rotated by 22.5 degrees, those values representing half of respective teeth, and FIG. 3D being an enlarged view of the main portion of FIG. 3C.
Figure 3C:
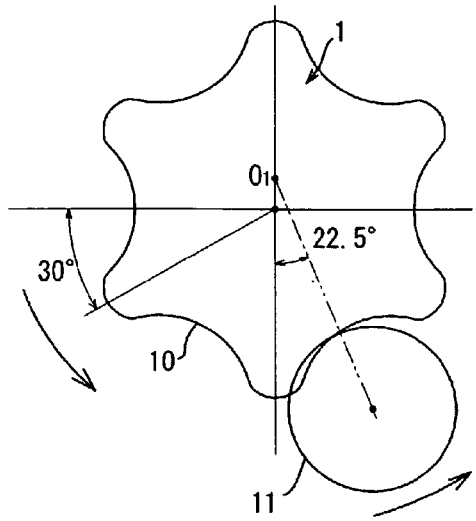
Figure 3B:
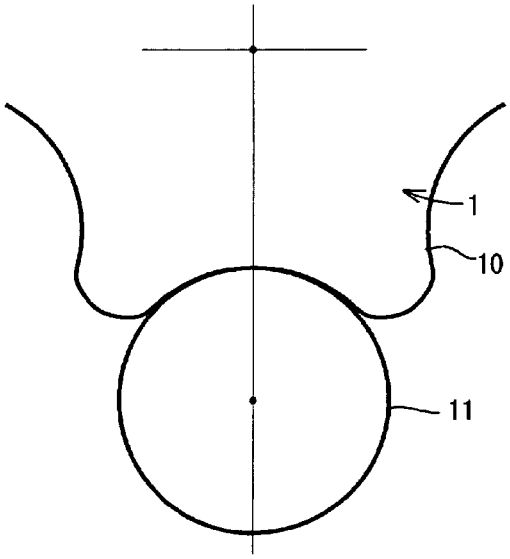

Initially, the number of row circles (number of teeth of the outer rotor) is set to 8 (S11). First, the inner rotor 1 has a total of 6 teeth containing three pairs of teeth disposed with left-right symmetry, and the inner rotor is disposed so that the tooth bottomland is oriented downward (position directly below the inner rotor in the figure) and so that the row circle 11 comes into contact with the tooth bottomland located directly below the inner rotor (S12) (FIG. 3A and FIG. 3B). In this state, the tooth bottomland of the inner rotor 1 and the tooth tip of the outer rotor 2 are meshed to the largest depth. Then, operations are performed to find a virtual center (outer rotor center) of a reference circle 50 (virtual circle) where the eight teeth are disposed, that is, a reference circle 50 (virtual circle: see FIG. 7A) where the row circles 11 (identical to the drawn circles c) are disposed. This operation can involve several cycles.

Figure 2:
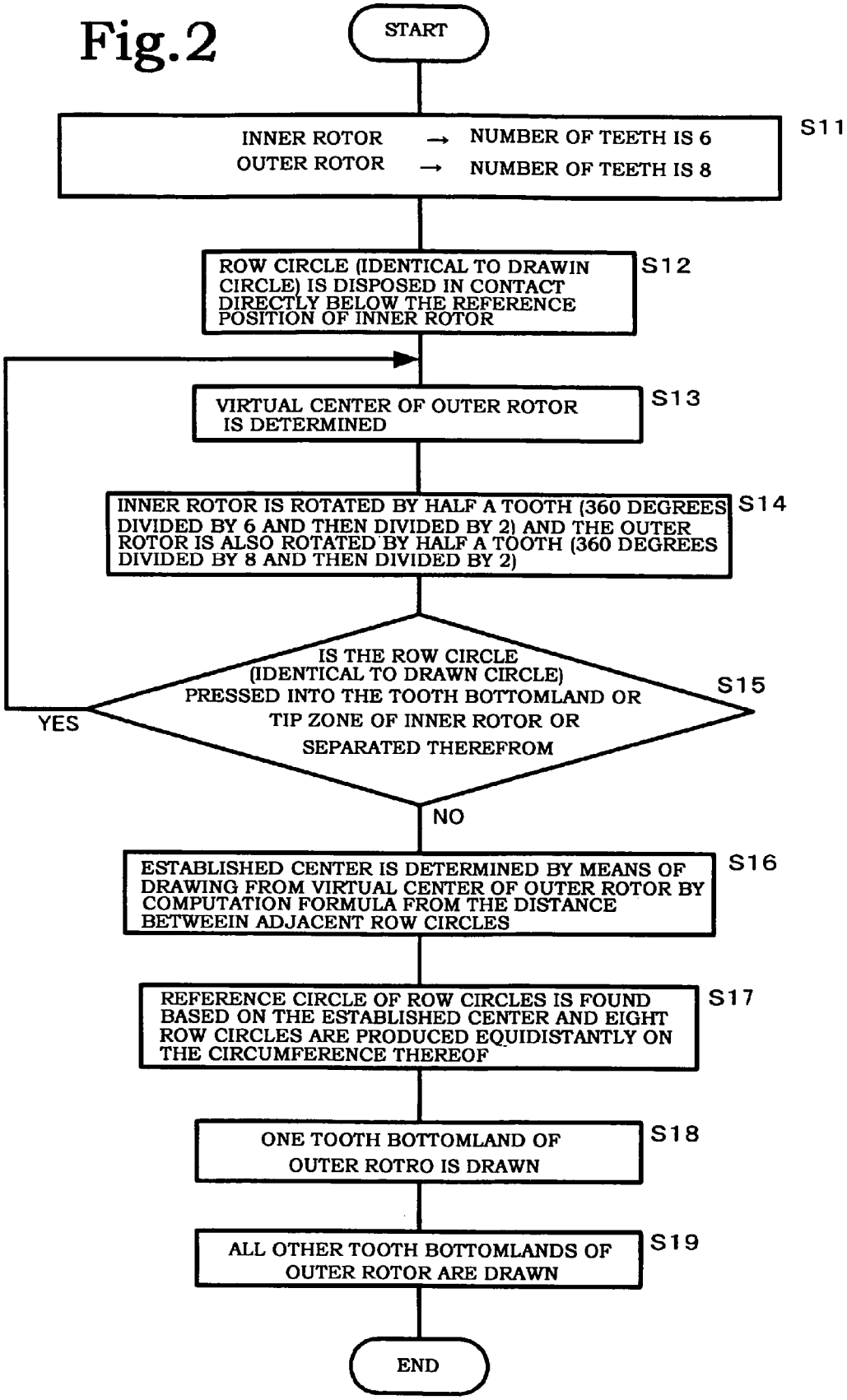
FIG. 2 is a flowchart of the manufacturing method of the first embodiment of the present invention.
Figure 3D:
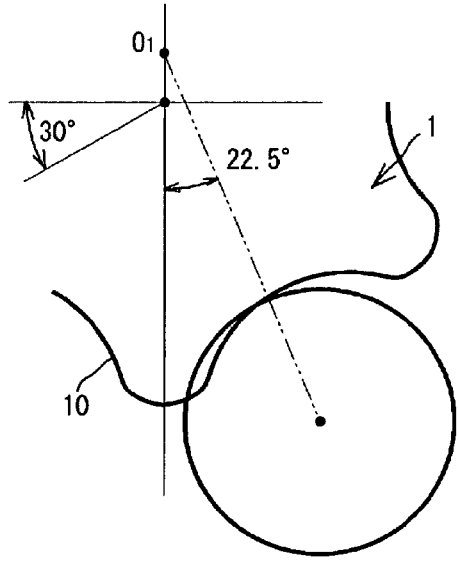

First, a first virtual center $O_1$ is tested (S13). Based on the mutual arrangement of the inner rotor 1 and outer rotor 2, the inner rotor 1 is rotated by half a tooth about the inner rotor center. Thus, the inner rotor 1 having 6 teeth is rotated by half a tooth (60 degrees divided by 2) about the inner rotor center, and the outer rotor having 8 teeth is also rotated by half a tooth (45 degrees divided by 2) about the first virtual center $O_1$ (S14) (FIG. 3C and FIG. 3D). At this time, it is determined whether the row circle 11 (identical to the drawn circle c) is pressed into the tooth bottomland or tooth tip zone of the inner rotor tooth profile 10 of the inner rotor 1 or separated therefrom (S15: see FIG. 2).

Figure 4A:
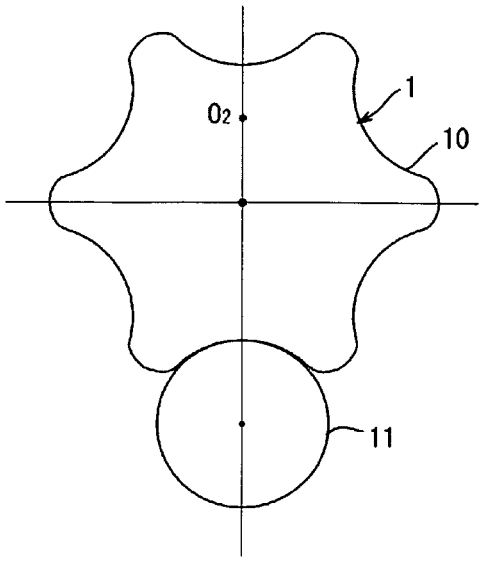
FIG. 4A illustrates a state in which a row circle comes into contact with the inner rotor, FIG. 4B being an enlarged view of the main portion of FIG. 4A, FIG. 4C illustrating a state in which the inner rotor is rotated by 30 degrees, and the outer rotor including the row circle is rotated by 22.5 degrees, those values representing half of respective teeth, and FIG. 4D being an enlarged view of the main portion of FIG. 4C.
Figure 4C:
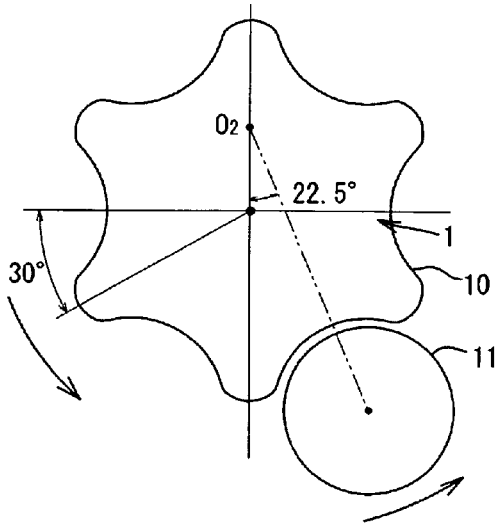
Figure 4B:
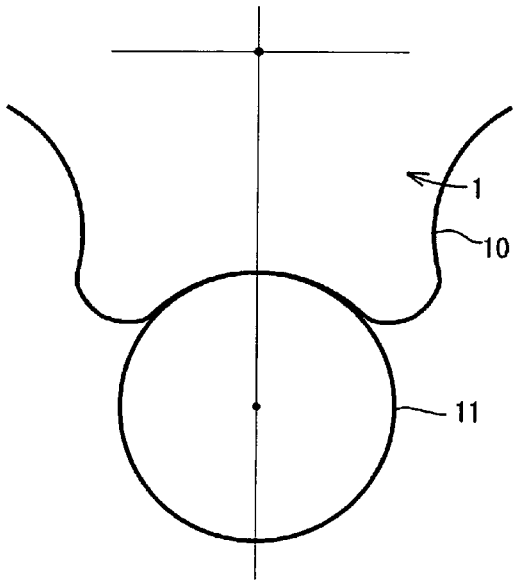
Figure 4D:
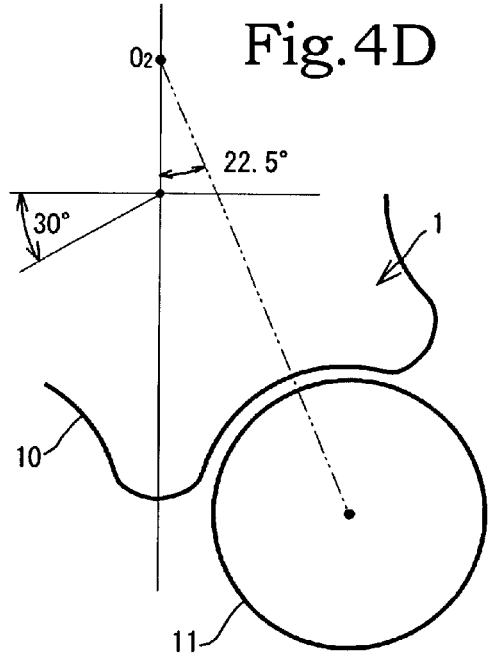

In the present example, a state is assumed in which the row circle 11 (drawn circle c: equivalent to the tooth tip of the outer rotor 2) is pressed into the tooth bottomland of the inner rotor 1 (see FIG. 3C and FIG. 3D). Accordingly, it is clear that smooth rotation is impossible. Therefore, the first virtual center $O_1$ is disregarded, the decision of step S15 shown in FIG. 2 is YES, and the processing flow returns to a stage preceding step S13. Then, the second virtual center $O_2$ is tested, as shown in FIG. 4 (S13). The same arrangement is used in which the row circle 11 comes into contact with the tooth bottomland located directly below the inner rotor (S12) (see FIG. 4A and FIG. 4B). As shown in FIG. 4C and FIG. 4D, the inner rotor 1 having 6 teeth is rotated by half a tooth (60 degrees divided by 2) from the rotor center, and the outer rotor having 8 teeth is also rotated by half a tooth (45 degrees divided by 2) about the second virtual center $O_2$ (S14). At this time, a state is assumed in which the row circle 11 (drawn circle c: equivalent to the tooth tip of the outer rotor 2) and the tooth bottomland of the inner rotor 1 are separated from each other (see FIG. 4C and FIG. 4D). In this case, too, smooth rotation is not performed. Therefore, the second virtual center $O_2$ is disregarded, the decision of step S15 is YES, and the processing flow returns to a stage preceding step S13.

Figure 5A:
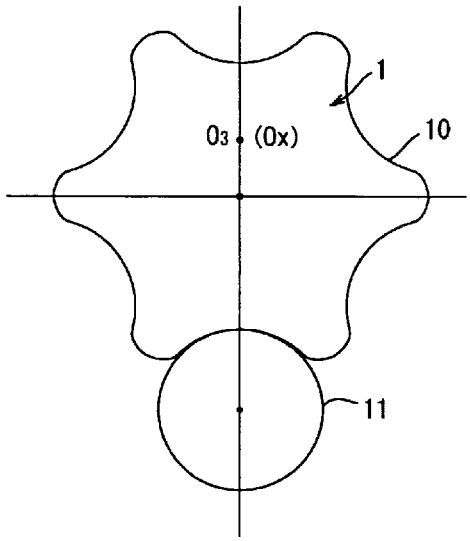
FIG. 5A illustrates a state in which a row circle comes into contact with the inner rotor, FIG. 5B being an enlarged view of the main portion of FIG. 5A, FIG. 5C illustrating a state in which the inner rotor is rotated by 30 degrees, and the outer rotor including the row circle is rotated by 22.5 degrees, those values representing half of respective teeth, and FIG. 5D being an enlarged view of the main portion of FIG. 5C.
Figure 5C:
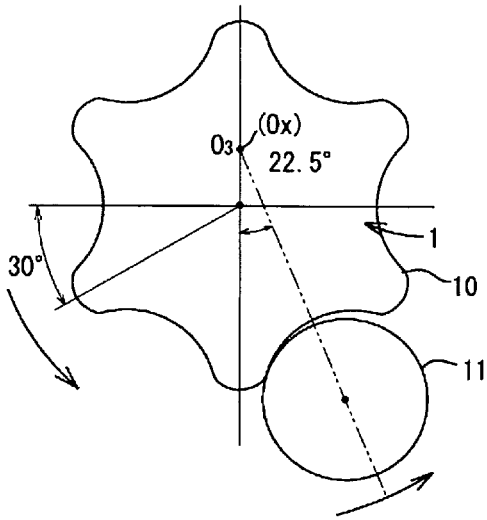
Figure 5B:
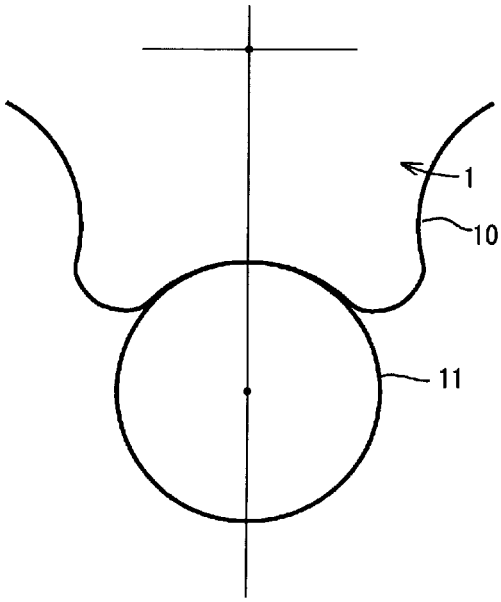
Figure 5D:
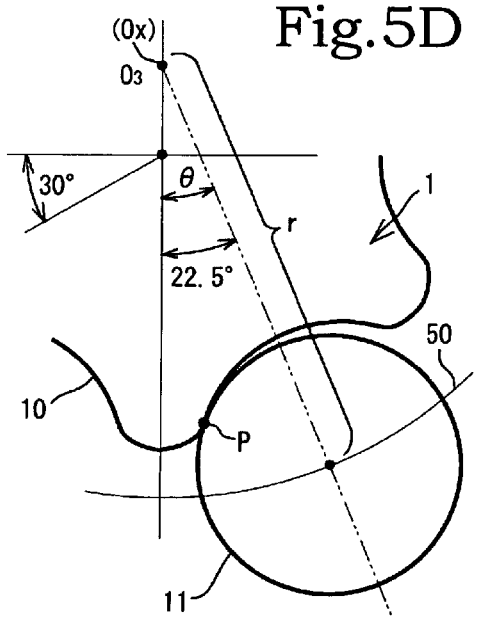

The third virtual center $O_3$ is then tested (S13). As shown FIG. 5A and FIG. 5B, a similar contact is assumed. As shown in FIG. 5C and FIG. 5D, the inner rotor having 6 teeth is rotated by half a tooth (60 degrees divided by 2) from the center thereof, and the outer rotor having 8 teeth is also rotated by half a tooth (45 degrees divided by 2) about the third virtual center $O_3$ (S14). In this case, a state is assumed in which the tooth bottomland of the inner rotor 1 and the row circle 11 (drawn circle c: equivalent to the tooth tip of the outer rotor 2) are in contact with each other (see FIG. 5C and FIG. 5D). Accordingly smooth rotation is assumed, the decision of step S15 is NO, and the third virtual center $O_3$ is determined as an established center $O_x$ of the outer rotor 2 (S16). This is a method of manufacturing by drawing. When the inner rotor 1 and various virtual outer rotors 2 are rotated by half of a respective tooth, there exist only one virtual center and one virtual circle radius at which the tooth bottomland of the inner rotor 1 and row circle 11 come into contact.

Figure 6A:
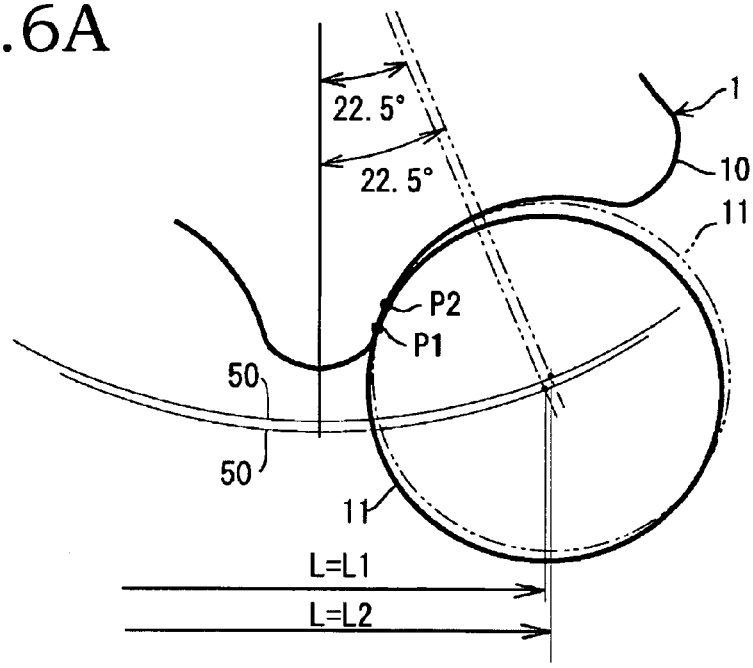
FIG. 6A illustrates a state in which the radius is found a plurality of times in the state shown in FIG. 5D, FIG. 6B illustrating a state of FIG. 6A shown with left-right symmetry.
Figure 6B:
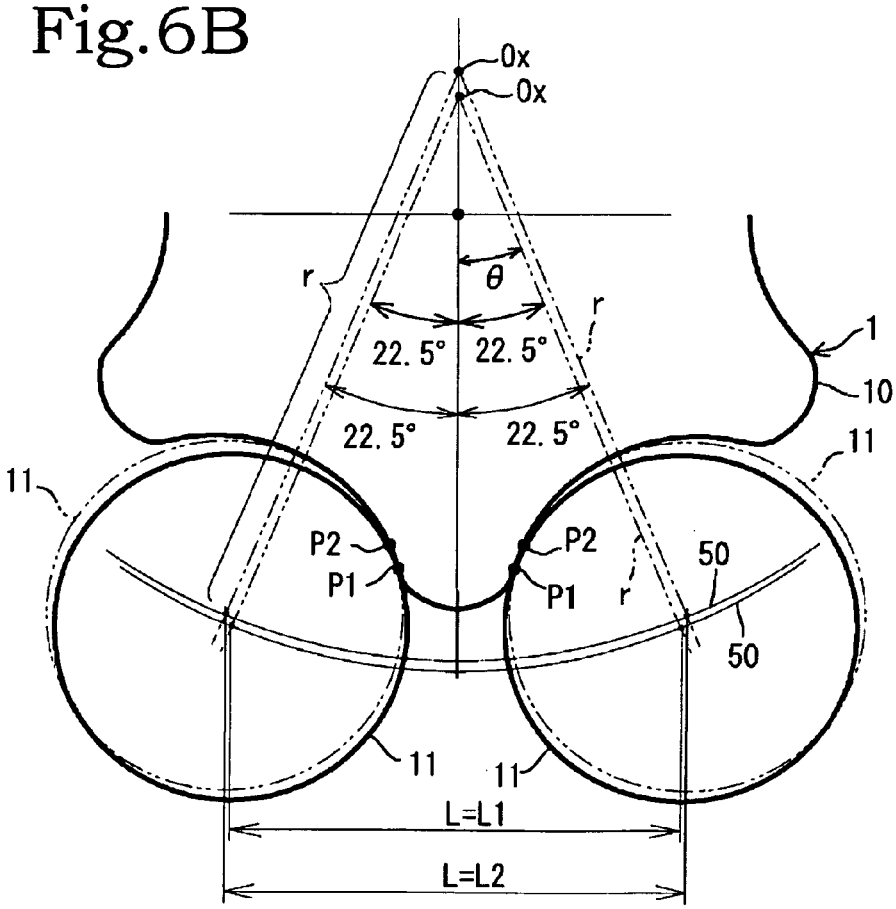

There is also a method for finding the radius from the established center $O_x$ by calculations. With such method, as shown in FIG. 5D, the radius can be found by the distance and rotation angle θ at the time at which a state is assumed in which the tooth bottomland of the inner rotor 1 and the row circle 11 (drawn circle c: equivalent to the tooth tip of the outer rotor 2) come into contact. Explaining it in a manner that is easy to understand, as shown in FIG. 6, where the row circles 11 are assumed to be provided on the left and right sides in FIG. 5D so as to hold the tooth tip zone of the inner rotor 1 from both sides, the distance between the row circles 11, 11 on the left and right sides will be L and the rotation angel θ will be 22.5 degrees.

The radius r of the reference circle 50, which is being sought, can be found by the following equation $r=(L/2)/\sin\theta(2\pi/16)$. The established center $O_x$ thereof naturally can be also found.

Where the positions (distance L, L1, L2) of the two adjacent row circles 11, 11 from among the arranged row circles 11 (identical to the drawn circle c) can be established, the row circles 11 that are to be arranged can be arranged with the same spacing on the reference circle 50 (virtual circle). In other words, if the number of teeth N of the outer rotor 2 (the difference between this number and the number of teeth in the inner rotor is two or more) is determined in advance, then by finding the positions of the two adjacent row circles 11, 11, from among the row circles 11 defining the tooth tip profile of the outer rotor, it is possible to find the size of the outer rotor 2 itself (correspondingly to the size of the reference circle 50).

Figure 7A:
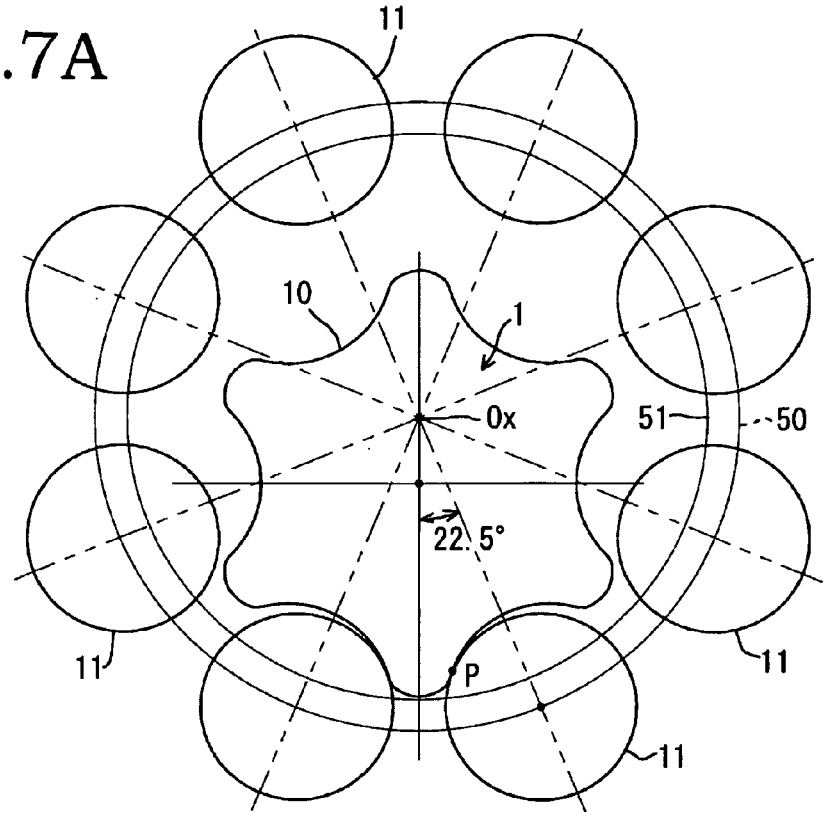
FIG. 7A illustrates a state in which a reference circle is drawn from an established center and row circles are provided equidistantly, FIG. 7B being a process diagram for finding the tooth tip position of an outer rotor, and FIG. 7C being a partial front view of the created outer rotor.
Figure 7B:
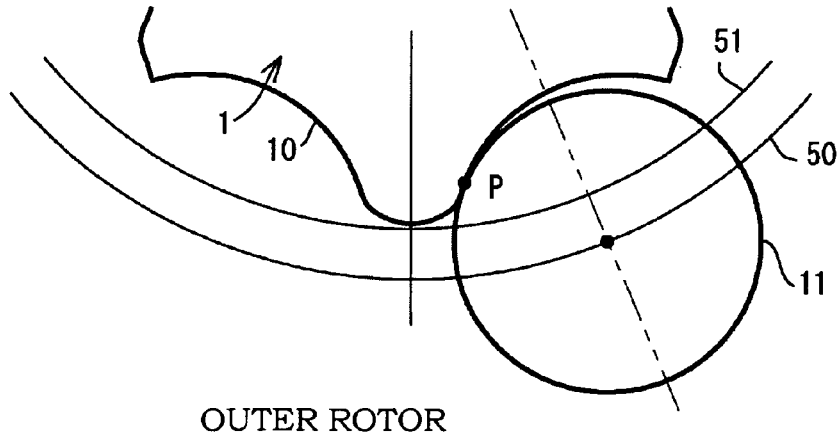
Figure 7C:
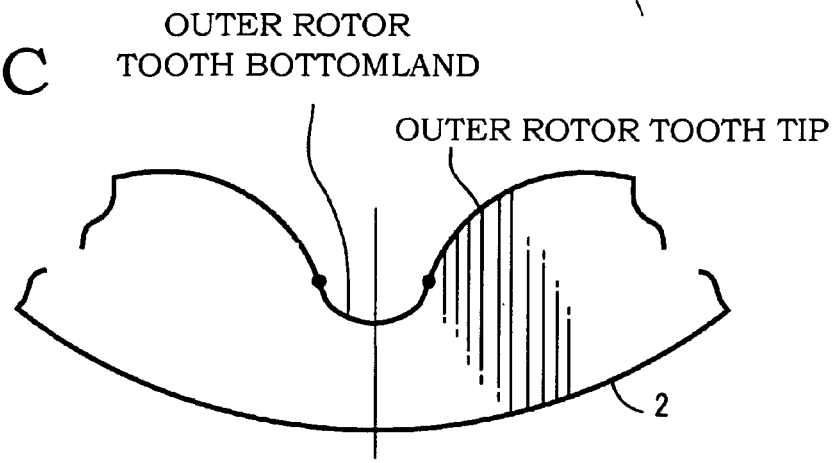
Figure 8A:
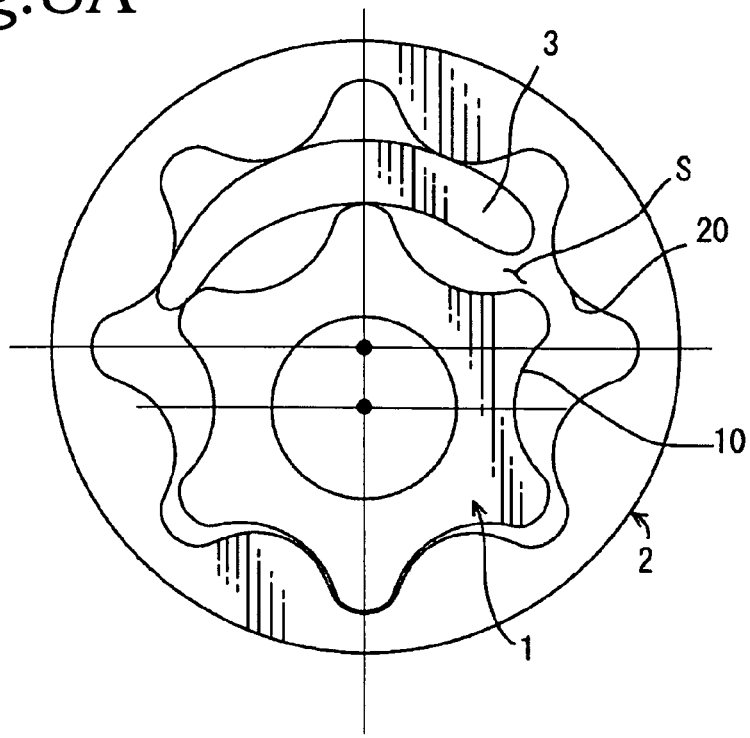
FIG. 8A shows a trochoid pump in which the inner rotor has 6 teeth and the outer rotor in accordance with the present invention has 8 teeth, FIG. 8B being a front view of the main portion shown in FIG. 8A.
Figure 8B:
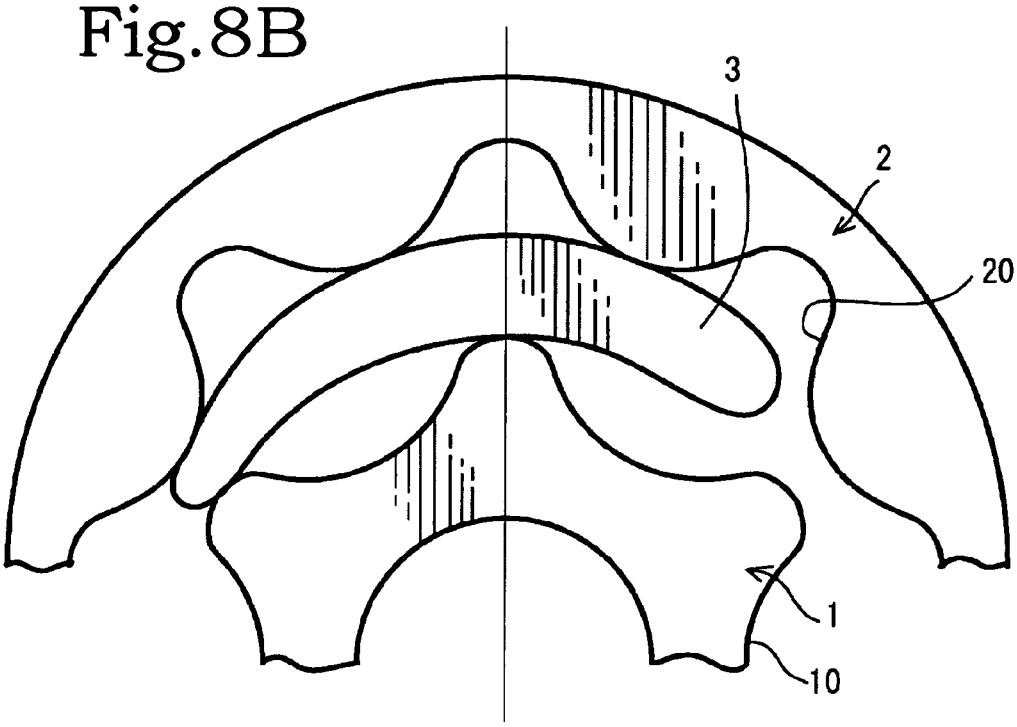
Figure 9:
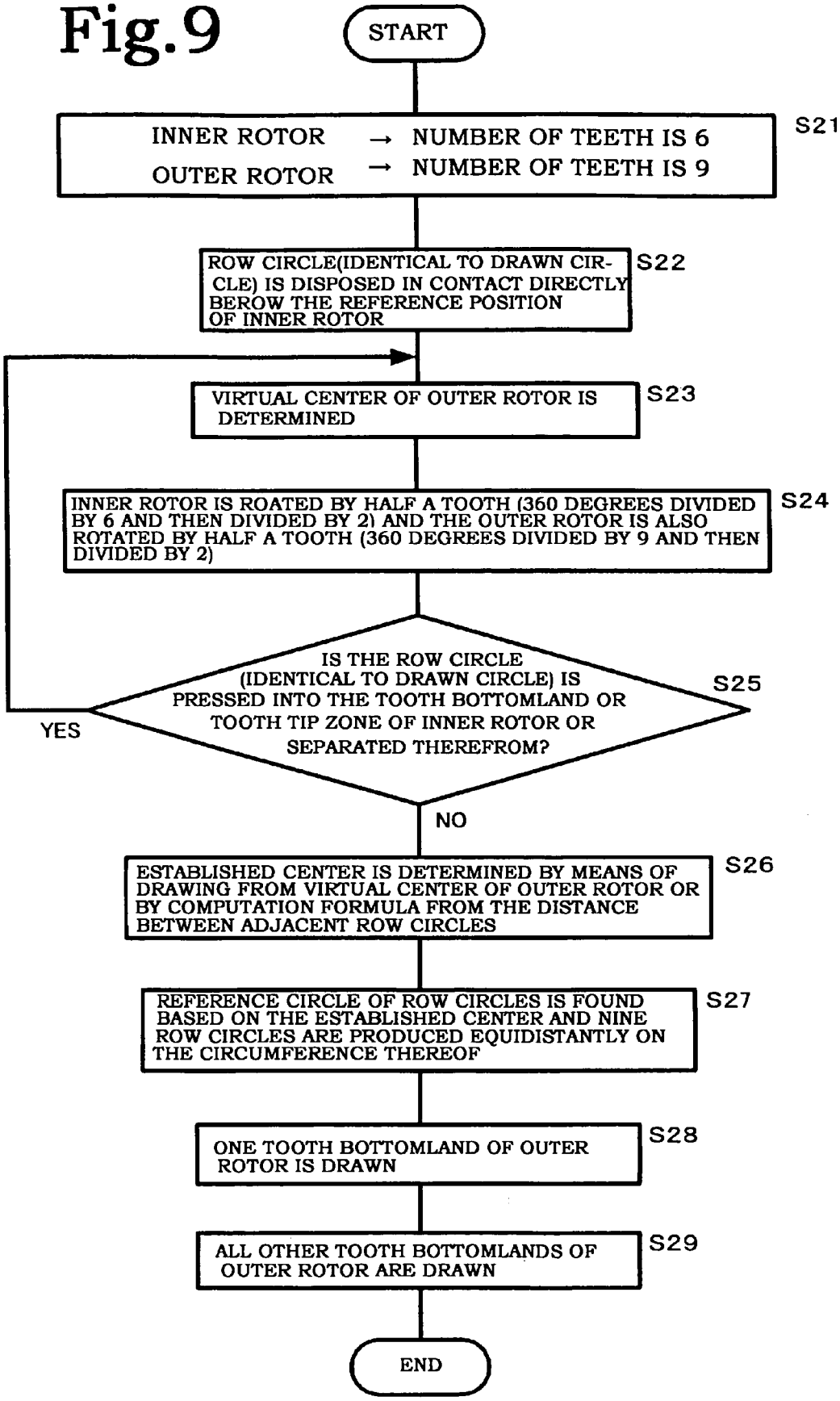
FIG. 9 is a flowchart of the manufacturing method of the second embodiment of the present invention.
Figure 10A:
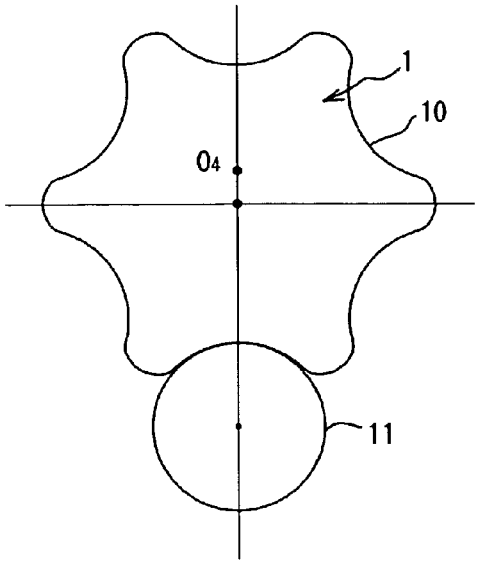
FIG. 10A illustrates a state in which a row circle comes into contact with the inner rotor, FIG. 10B being an enlarged view of the main portion of FIG. 10A, FIG. 10C illustrating a state in which the inner rotor is rotated by 30 degrees, and the outer rotor including the row circle is rotated by 20 degrees, those values representing half of respective teeth, and FIG. 10D being an enlarged view of the main portion of FIG. 10C.
Figure 10C:
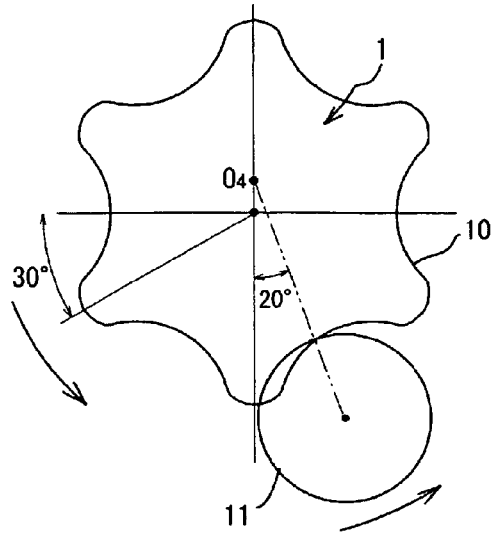
Figure 10B:
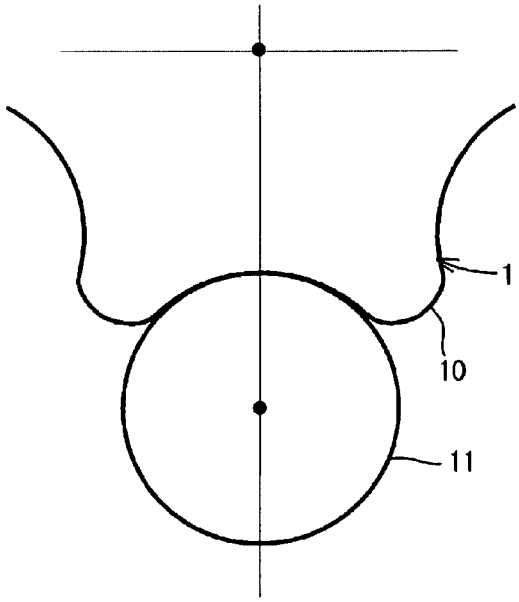
Figure 10D:
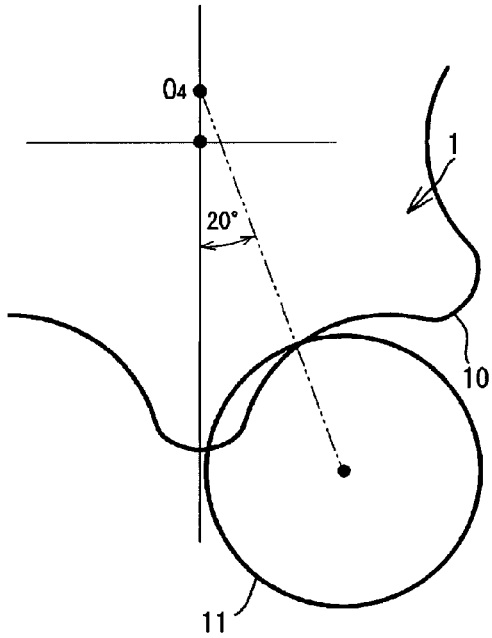
Figure 11A:
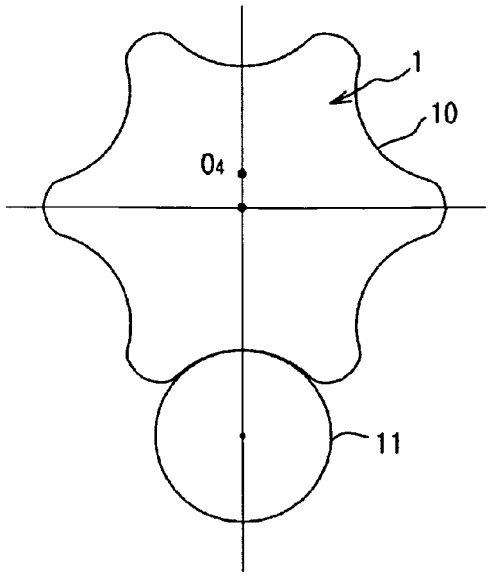
FIG. 11A illustrates a state in which a row circle comes into contact with the inner rotor, FIG. 11B being an enlarged view of the main portion of FIG. 11A, FIG. 11C illustrating a state in which the inner rotor is rotated by 30 degrees, and the outer rotor including the row circle is rotated by 20 degrees, those values representing half of respective teeth, and FIG. 11D being an enlarged view of the main portion of FIG. 11C.
Figure 11C:
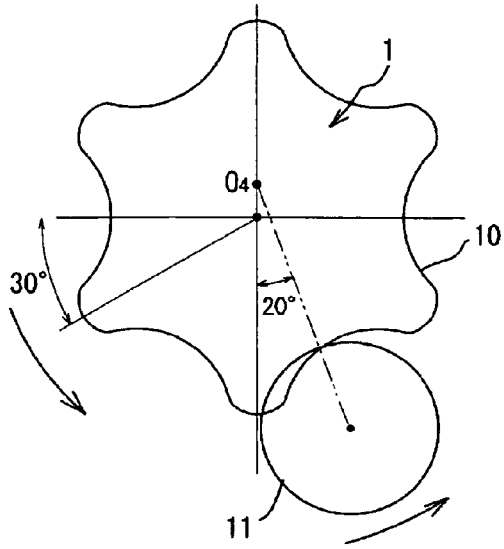
Figure 11B:
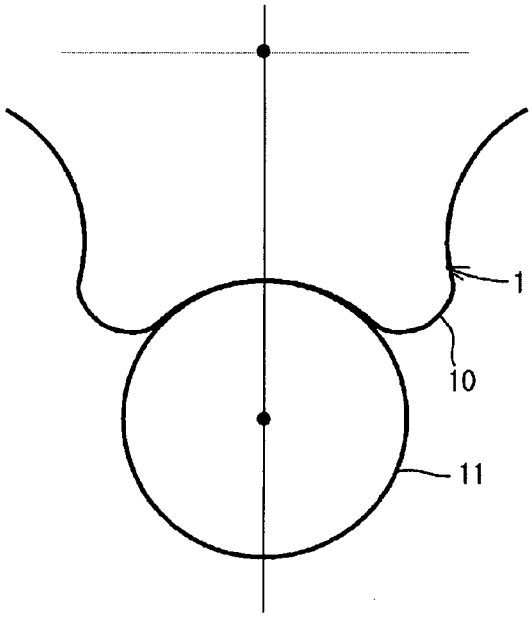
Figure 11D:
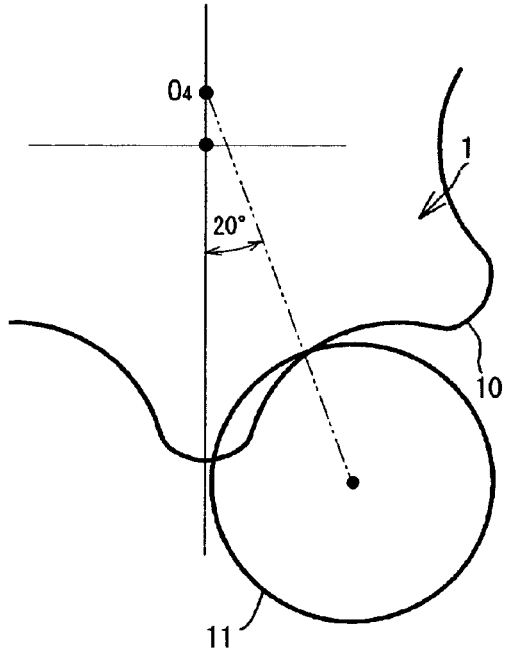
Figure 12A:
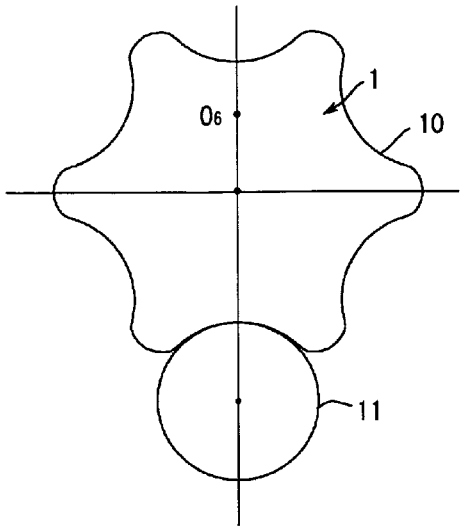
FIG. 12A illustrates a state in which a row circle comes into contact with the inner rotor, FIG. 12B being an enlarged view of the main portion of FIG. 12A, FIG. 12C illustrating a state in which the inner rotor is rotated by 30 degrees, and the outer rotor including the row circle is rotated by 20 degrees, those values representing half of respective teeth, and FIG. 12D being an enlarged view of the main portion of FIG. 12C.
Figure 12C:
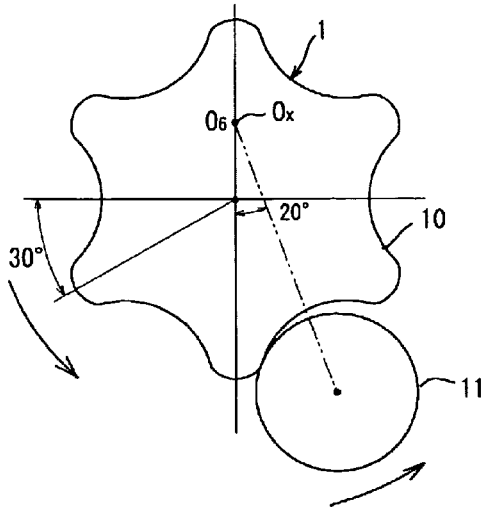
Figure 12B:
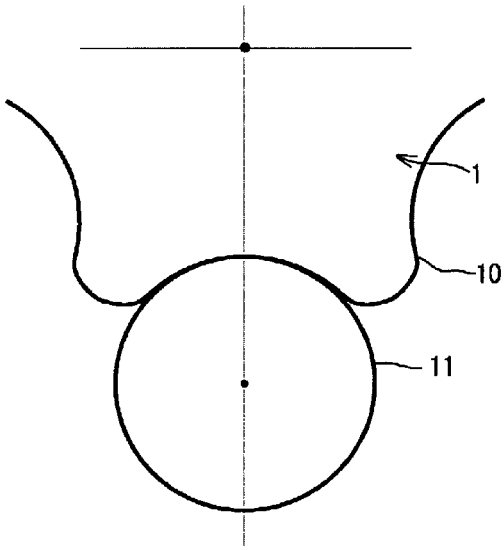
Figure 12D:
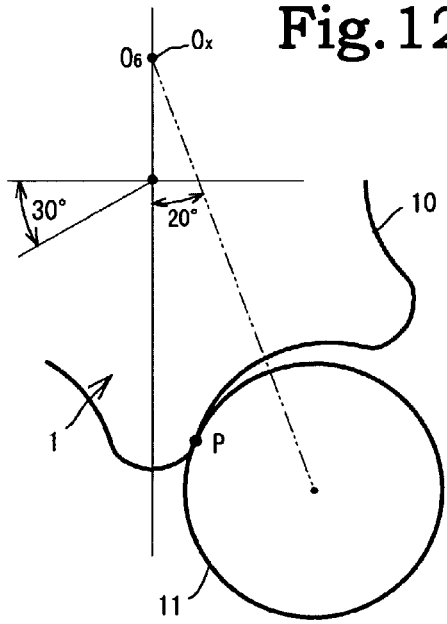
Figure 13A:
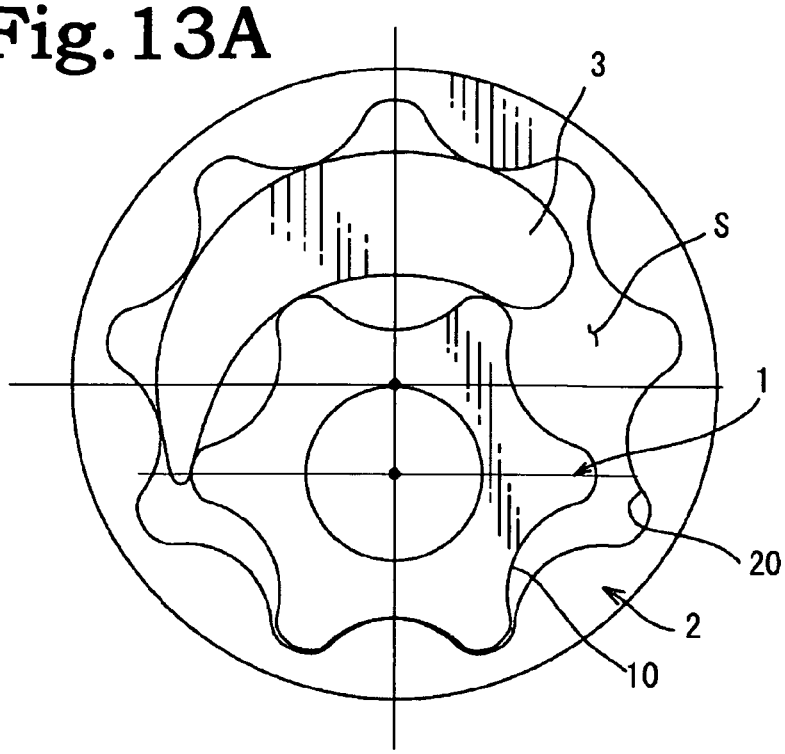
FIG. 13A shows a trochoid pump in which the inner rotor has 6 teeth and the outer rotor in accordance with the present invention has 9 teeth, FIG. 13B being a front view of the main portion shown in FIG. 13A.
Figure 13B:
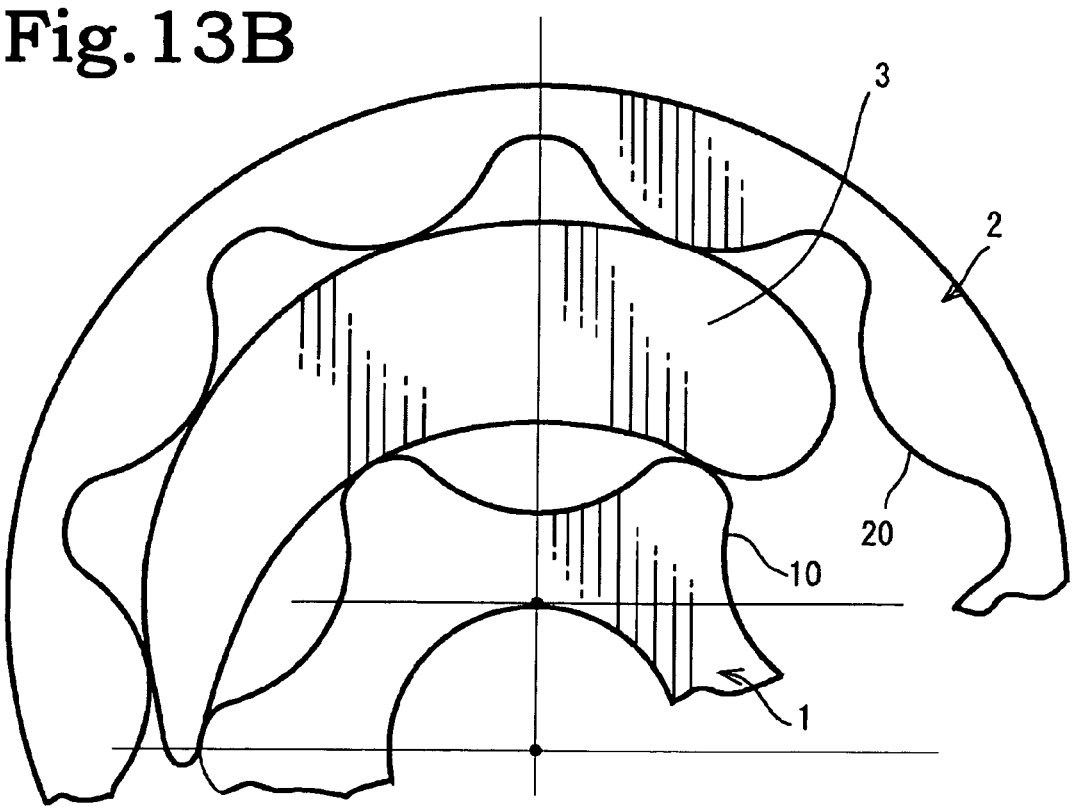

In any case, the reference circle 50 is drawn from the established center $O_x$ of the outer rotor 2, and a total of 8 circles are drawn (S17: see FIG. 7A) so as to obtain a phase difference of 45 degrees with the drawn row circles 11 (drawn circles c). Then, a tooth bottomland reference circle 51 is drawn, as shown in FIG. 7A and FIG. 7B, close to the distal end of the inner rotor 1 or in the tooth tip end zone (position slightly withdrawn from the distal end zone) about the established center $O_x$ of the outer rotor 2, and one tooth bottomland of the outer rotor 2 is determined (S18). The circles are also drawn with respect to other seven tooth tips and all the tooth bottomlands of the outer rotor 2 are determined (S19). The eight teeth of the outer rotor 2 are thus manufactured (designed).

As shown in FIG. 6, the radius of the reference circle (virtual circle) and the established center $O_x$ differ depending on whether the position in which the row circle 11 (tooth tip of the outer rotor 2) comes into contact with the tooth surface of the inner rotor 1 is a contact point $P_1$, which is closer to the tooth tip, or a contact point $P_2$, which is closer to the tooth bottomland. In other words, where the row circle 11 comes into contact in the contact point $P_1$ closer to the tooth tip, the reference circle 50 (virtual circle) will have a small radius, and where the row circle comes into contact in the contact point $P_2$ closer to the tooth bottomland, the reference circle 50 (virtual circle) will have a large radium.

Second Embodiment of the Present Invention

Manufacture (Design) Procedure in the Case of an Inner Rotor with 6 Teeth and an Outer Rotor with 9 Teeth As shown in FIG. 9 through FIG. 13, in this case, the difference in the number of teeth is 3, the inner rotor having 6 teeth is rotated by half a tooth (60 degrees divided by 2) from the center of the inner rotor 1 and the outer rotor 2 having 9 teeth is also rotated by half a tooth (40 degrees divided by 2) about the first virtual center $O_4$, $O_5$, $O_6$. This manufacturing method is similar to that of the first embodiment and makes it possible to find the established center $O_x$ of the outer center 2. In other words, with the exception of the below-described case in the which the rotation angle θ of the outer rotor 2 is 20 degrees, this manufacturing method is identical to the method of the first embodiment. In other words, this is the manufacturing method including steps S21 to S29 shown in FIG. 9.

<Manufacture (Design) Procedure in the Case of an Inner Rotor with N (4 or more) Teeth and an Outer Rotor with a Number of Teeth that is N Plus a Natural Number Equal to or Larger Than 2>

Figure 1:
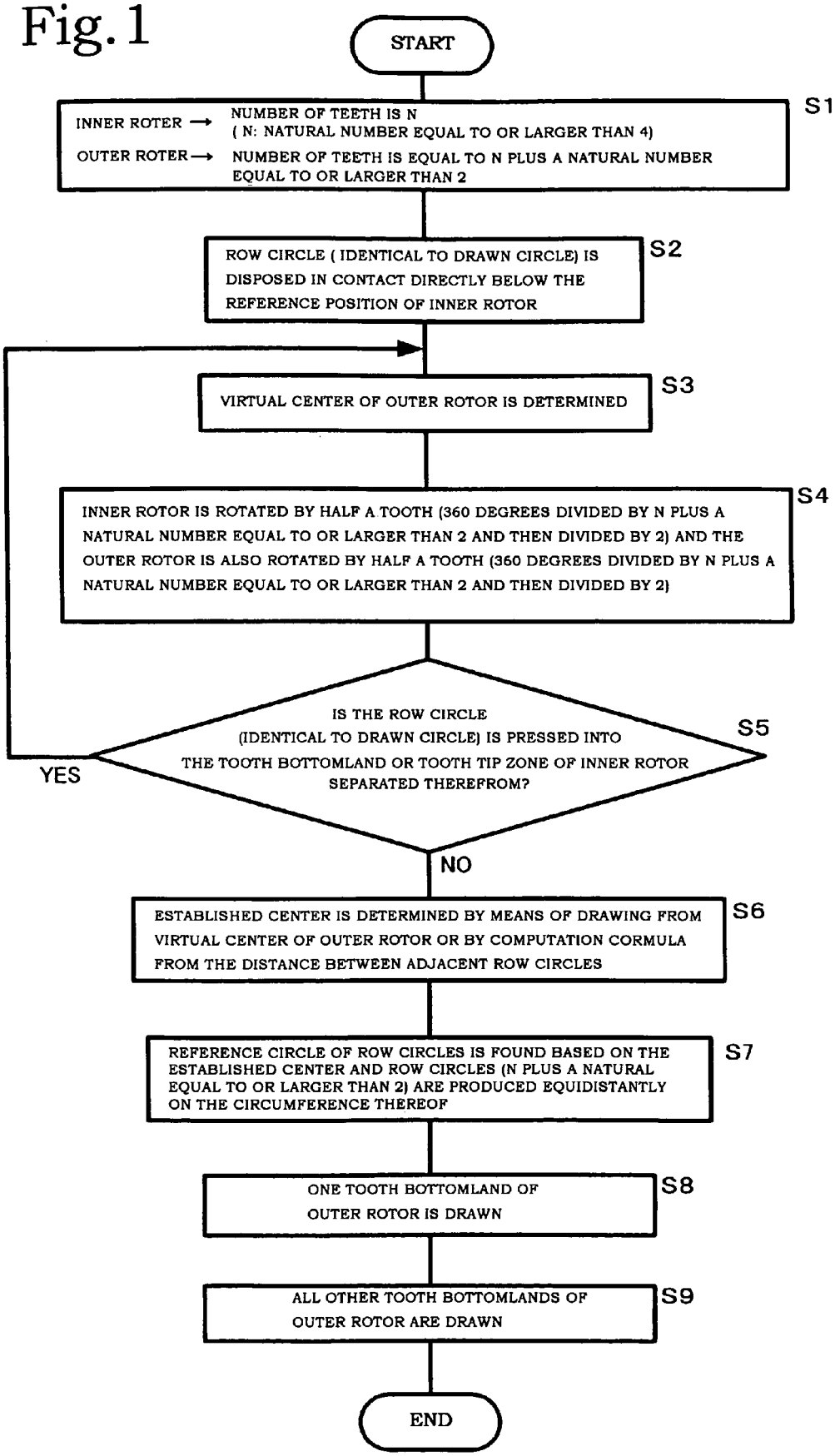
FIG. 1 is a flowchart of a manufacturing method of a higher concept of the present invention.

This manufacture (design) procedure is shown in FIG. 1. The number N of teeth of the inner rotor is taken as 4 or more. The number of row circles 11 (number of teeth of the outer rotor) is set to N plus a natural number equal to or larger than 2 (S1). First, the inner rotor 1 is disposed so as to have a left-right symmetry and so that a tooth bottomland is located directly below. The row circle 11 is disposed so as to come into contact with the tooth bottomland that is disposed directly below (S2). In this state, the tooth bottomland of the inner rotor 1 and the tooth tip of the outer rotor 2 are meshed to the largest depth. Then, operations are performed to find a virtual center of a circle (virtual circle) where the row circles 11 are disposed, that is, a reference circle 50 (virtual circle) where the number of teeth is N plus a natural number equal to or larger than 2. This operation can involve several cycles.

First, a first virtual center $O_1$ is tested (S3). Based on the mutual arrangement of the inner rotor and outer rotor, the inner rotor 1 is rotated by half a tooth about the inner rotor center. Thus, the inner rotor 1 having N teeth is rotated by half a tooth (360 degrees divided by N and then divided by 2) about the center of the inner rotor 1, and the outer rotor 2 having the N+2 teeth is also rotated by half a tooth (360 divided by (N+2) and then divided by 2) about the first virtual center $O_1$ (S4). At this time, it is determined whether the row circle is pressed into the tooth bottomland or tooth tip zone of the inner rotor 1 or separated therefrom (S5).

For example, a state is assumed in which the tooth tip (drawn circle: row circle) of the outer rotor 2 is pressed into the tooth bottomland of the inner rotor 1. Accordingly, it is clear that smooth rotation is impossible. Therefore, the first virtual center $O_1$ is disregarded, the decision of step S5 is YES, and the processing flow returns to a stage preceding step S3. Then, the second virtual center $O_2$ is tested (S3). The rotation is performed in a similar manner (S4). In this case, a state is assumed in which the tooth tip (drawn circle: row circle) of the outer rotor 2 and the tooth bottomland of the inner rotor 1 are separated from each other. In this case, too, smooth rotation is not performed. Therefore, the second virtual center is disregarded, the decision of step S5 is YES, and the processing flow returns to a stage preceding step S3. The third virtual center $O_3$ is then tested (S3). The rotation is performed in a similar manner (S3).

In this case, a state is assumed in which the tooth tip (drawn circle: row circle) of the outer rotor 2 and the tooth bottomland of the inner rotor 1 are in contact with each other. Accordingly smooth rotation is assumed, the decision of step S5 is NO, and the third virtual center is determined as an established center of the outer rotor 2 (S6). This is also a method for finding the radius from the established center by calculations. With such method, radius of the reference circle 50, which is being sought, can be found by the following equation r=(L/2)/sin θ(π/(N plus a natural number equal to or larger than 2)). The established center thereof naturally can be also found.

Further, a reference circle is then drawn about the established center of the outer rotor 2, and a total of N+2 circles are drawn so that each of them has a phase difference obtained by dividing 360 degrees by N+2 with respect to the corresponding drawn row circles (drawn circles) (S7). A circle is then drawn about the established center of the outer rotor 2 in a location close to the tooth tip end or at the location of the tooth tip end on the drawing of the inner rotor 1 and one tooth bottomland of the outer rotor 2 is determined (S8). Similar circles are then also drawn with respect to other remaining tooth tips and all the tooth bottomlands of the outer rotor 2 are determined (S9).

The outer rotor in which the number of teeth is equal to N+2 is thus manufactured (designed). Further, the same procedure can be used in the case where the number of teeth is N plus a natural number equal to or larger than 3. With the manufacturing method in accordance with the present invention, the outer rotor can be designed by the same method in accordance with the present invention even when the difference in the number of teeth between the inner rotor 1 and outer rotor 2 is two or more.

There is also a manufacturing method in which the half-tooth rotation process is reversed, the inner rotor tooth profile is rotated by half a tooth about the inner rotor center and also rotated by half a tooth of the predetermined number (N plus a natural number equal to or larger than 2) of teeth about the virtual center from the time at which a state is assumed in which the row circles come into contact with the tooth bottomland or tooth tip zone of the inner rotor tooth profile, while taking the appropriate virtual center of the row circles 11 as a center, the row circles are disposed so as to be in contact with the tooth bottomlands of the inner rotor tooth profiles, and the virtual center is determined as the established center. Further, a procedure in which the half-tooth rotation process is reversed can be also applied to a method for manufacturing a configuration in which the inner rotor has 6 teeth and the outer rotor has 8 teeth, or a method for manufacturing a configuration in which the inner rotor has 6 teeth and the outer rotor has 9 teeth. In other words, a transition is made from the states shown in FIG. 5C and FIG. 5D to the steps shown in FIG. 5A and FIG. 5B, or from the states shown in FIG. 12C and FIG. 12D to the steps shown in FIG. 12A and FIG. 12B. This method also yields the same effect.

In the conventional method for designing a rotor "having a trochoid shape", it is necessary that all the tooth tips of the inner rotor and all the tooth tips of the outer rotor roll theoretically without slip, while theoretically maintaining contact (actually, the tooth profile correction is performed by taking a clearance or the like into account, and the tooth tips are neither in perfect contact nor they are without a slip. However, the amount of such correction is several tens of microns, and the tooth profile correction up to this level is included in the scope of the present invention). For this reason, with the conventional design method, it is impossible to design a rotor having a trochoid shape with a large clearance between the tooth surface of the inner rotor 1 and the tooth surface of outer rotor 2 in which the difference in the number of teeth between the rotors is equal to or larger than 2.

By contrast, the present invention can provide a trochoid oil pump comprising the inner rotor 1 with almost perfect trochoid shape, the outer rotor 2 that is designed based on the tooth surface shape of the inner rotor 1, smoothly rotates, and has at least two teeth more than the inner rotor, and the crescent 3 of a crescent shape that is disposed between the inner rotor 1 with almost perfect trochoid shape and the outer rotor 2. Further, the tooth profile of the outer rotor 2 designed according to the present invention is used at a minimum in a portion of the outer rotor 2 where the tooth profiles of the inner rotor 1 and outer rotor 2 are meshed (the inner rotor 1 is a typical part that has a trochoid shape). In the tooth tip or tooth bottomland that is a portion where the inner rotor 1 and outer rotor 2 are not meshed, the tooth profile shape can be changed by an appropriate design. Further, it seems to be difficult to produce the outer rotor 2 with a trochoid tooth profile that has two or more teeth more than the inner rotor and is smoothly meshed therewith by a method other than the method in accordance with the present invention in which the rotation is performed by half a tooth.

Figure 15:
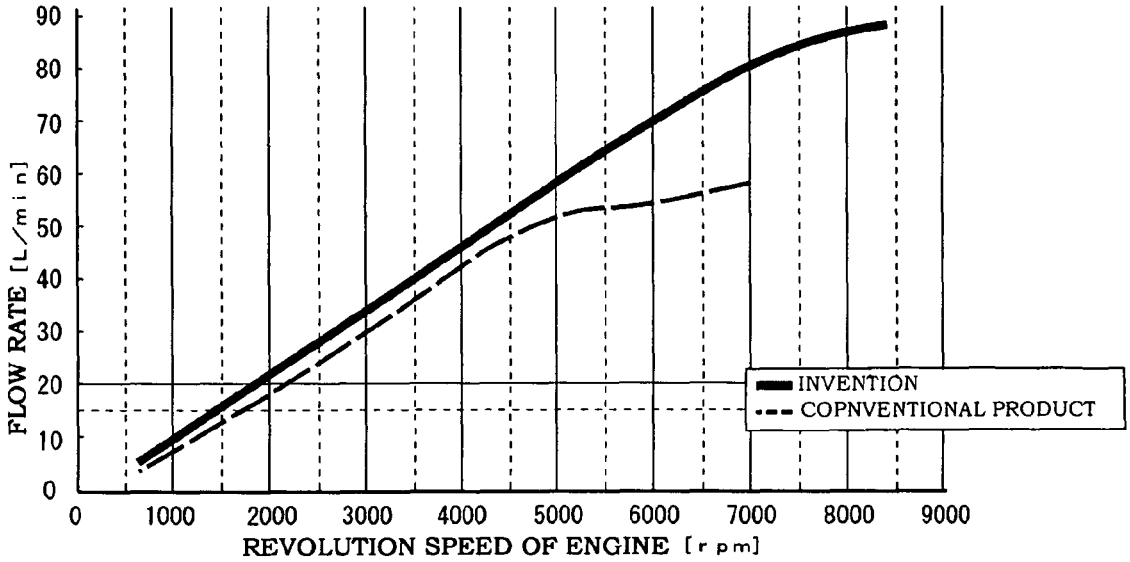
FIG. 15 is a graph illustrating the relationship between the engine revolution speed and the flow rate.

The shape of the tooth profile section of the outer rotor 2 that meshes with the inner rotor 1 is within a narrow range of about several tens of microns, even when the tooth profile shape correction of the clearance (generally about 40 micron) between the teeth is included, and the tooth profile shape of the meshing section of the outer rotor 2 is uniquely determined by the present invention. Further, as shown in the graph representing the relationship between the flow rate and revolution speed of an engine that is shown in FIG. 15, the present invention makes it possible to increase the flow rate in the case the revolution speed is equal to or higher than about 5000 rpm and increase the pump efficiency. Further, the cycloid shape is a specific case of a trochoid shape in which the rolling circle diameter is equal to eccentricity, and the cycloid is also included in the scope of the present invention.

What is claimed is:

1. A method for manufacturing a trochoid pump having a crescent, wherein an inner rotor, which comprises an inner rotor tooth profile as a trochoid tooth profile represented by a drawn circle of a predetermined radius, is formed in advance, with a number of teeth of the inner rotor being set to a first predetermined number comprising a number that is equal to or larger than four, in order to manufacture an outer rotor with a second predetermined number comprising said first predetermined number plus a natural number equal to or larger than two of teeth, row circles that are identical to the drawn circle are disposed so as to bring the row circles into contact with a tooth bottomland of the inner rotor tooth profile, the inner rotor tooth profile is rotated by a half of a tooth about a center of the inner rotor and an outer rotor tooth profile is also rotated by a half of a tooth of the second predetermined number of teeth about an appropriate virtual center of the outer rotor including the row circles, an established center is determined by a mathematical expression from the appropriate virtual center at a time at which the row circles assume, in a course of the rotation, a state of being in contact, without penetration or separation, with the tooth bottomland or a tooth tip zone of the inner rotor tooth profile, or from an interval between adjacent row circles at a time at which a contact state is assumed, a reference circle is drawn that comprises a radius from the established center to the row circles and that comprises the total second predetermined number of the equidistantly spaced row circles to form the row circles as outer rotor tooth tips, and the outer rotor tooth profile is manufactured.

2. The method for manufacturing a trochoid pump according to claim 1, wherein the half-tooth rotation process is reversed such that the inner rotor tooth profile is rotated by a half of a tooth about the inner rotor center and the outer rotor tooth profile is also rotated by a half of a tooth of the second predetermined number of teeth about the virtual center from a time at which a state is assumed in which the row circles come into contact with the tooth bottomland or tooth tip zone of the inner rotor tooth profile, while taking the appropriate virtual center of the outer rotor including the row circles as a center, the row circles are disposed so as to be in contact with the tooth bottomland of the inner rotor tooth profile, and the virtual center is determined as an established center.

3. The method for manufacturing a trochoid pump according to claim 2, wherein a reference circle that has the total second predetermined number of the equidistantly spaced row circles is drawn and then an appropriate circle is drawn that serves as an outer rotor tooth bottomland in a zone at a tooth tip end or close to the tooth tip end of the inner rotor from the established center to form the outer rotor tooth bottomland, and the outer rotor tooth profile is manufactured.

4. The method for manufacturing a trochoid pump according to claim 2, wherein in order to manufacture a third predetermined number of outer rotor teeth, said third predetermined number comprising one of the first predetermined number plus two or the first predetermined number plus three, the inner rotor tooth profile is rotated by half a tooth about the inner rotor center and the outer rotor tooth profile is also rotated by half a tooth of the third predetermined number of teeth about the appropriate virtual center of the outer rotor including the row circles, and the outer rotor tooth profile is manufactured.

5. The method for manufacturing a trochoid pump according to claim 2, wherein the inner rotor has the inner rotor tooth profile produced from the drawn circle of the predetermined radius based on a trochoid curve produced by a rolling circle having an appropriate eccentricity with respect to a base circle.

6. The method for manufacturing a trochoid pump according to claim 1, wherein the reference circle that has the total second predetermined number of the equidistantly spaced row circles is drawn and then an appropriate circle is drawn that serves as an outer rotor tooth bottomland in a zone at a tooth tip end or close to the tooth tip end of the inner rotor from the established center to form the outer rotor tooth bottomland, and the outer rotor tooth profile is manufactured.

7. The method for manufacturing a trochoid pump according to claim 1, wherein in order to manufacture a third predetermined number of outer rotor teeth, said third predetermined number comprising one of the first predetermined number plus two or the first predetermined number plus three, the inner rotor tooth profile is rotated by half a tooth about the inner rotor center and the outer rotor tooth profile is also rotated by half a tooth of the the third predetermined number of teeth about the appropriate virtual center of the outer rotor including the row circles, and the outer rotor tooth profile is manufactured.

8. The method for manufacturing a trochoid pump according to claim 1, wherein the inner rotor has the inner rotor tooth profile produced from the drawn circle of the predetermined radius based on a trochoid curve produced by a rolling circle having an appropriate eccentricity with respect to a base circle.

* * * * *